US009789983B2

(12) United States Patent
Brandhorst et al.

(10) Patent No.: US 9,789,983 B2
(45) Date of Patent: Oct. 17, 2017

(54) METHOD AND APPARATUS FOR INSERTING PACKAGES INTO CARTONS

(71) Applicant: FOCKE & CO. (GMBH & CO. KG), Verden (DE)

(72) Inventors: Bjorn Brandhorst, Horstel (DE); Frank Sachs, Saterland (DE); Andreas Neufeld, Ostrhauderfehn (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 468 days.

(21) Appl. No.: 14/384,819

(22) PCT Filed: Feb. 22, 2013

(86) PCT No.: PCT/EP2013/000514
§ 371 (c)(1),
(2) Date: Sep. 12, 2014

(87) PCT Pub. No.: WO2013/143637
PCT Pub. Date: Oct. 3, 2013

(65) Prior Publication Data

US 2015/0013277 A1 Jan. 15, 2015

(30) Foreign Application Priority Data

Mar. 29, 2012 (DE) ..... 10 2012 006 278

(51) Int. Cl.
*B65B 5/06* (2006.01)
*B65B 5/10* (2006.01)
(Continued)

(52) U.S. Cl.
CPC ..... *B65B 5/105* (2013.01); *B65B 35/18* (2013.01); *B65B 35/52* (2013.01)

(58) Field of Classification Search
CPC ..... B65B 5/061; B65B 5/064; B65B 5/106; B65B 35/18; B65B 5/105; B65B 35/52
See application file for complete search history.

(56) References Cited

U.S. PATENT DOCUMENTS 5,778,640 A * 7/1998 Prakken ..... B65B 5/061 53/244
7,856,797 B2 * 12/2010 Black ..... B65B 5/061 53/147
(Continued)

FOREIGN PATENT DOCUMENTS

CN 1493499 A 5/2004
CN 1931671 A 3/2007
(Continued)

OTHER PUBLICATIONS

Studio Torta (private Itailan law firm), Remarks made to the European Patent Office in connection with a related European patent application, Nov. 2, 2015—Not considered prior art by the Applicant but submitted as a precautionary measure.
(Continued)

*Primary Examiner* — Andrew M Tecco
*Assistant Examiner* — Praachi M Pathak
(74) *Attorney, Agent, or Firm* — Laurence P. Colton; Smith Tempel Blaha LLC

(57) ABSTRACT

For the automatic insertion of packs (11) into a large-volume carton (10), two work tools are used, namely, a pack robot (33) with carton holder (30) for holding the cartons (10) ready and a pack robot (33) with head (37) for inserting the individual packs (11) one after another into the carton (10) in the region of a packing station (33). Through relative movement of carton (10) and pack (11), different pack formations are created within the carton (10).

12 Claims, 9 Drawing Sheets

(51) Int. Cl.
*B65B 35/18* (2006.01)
*B65B 35/52* (2006.01)

(56) References Cited

U.S. PATENT DOCUMENTS

| | | | | |
|---|---|---|---|---|
| 8,386,069 | B2 * | 2/2013 | Hartmann | G05B 19/4103 318/34 |
| 9,346,169 | B2 * | 5/2016 | Burns | B25J 9/1687 |
| 9,346,170 | B2 * | 5/2016 | Baylor | B25J 9/1697 |
| 2009/0249750 | A1 * | 10/2009 | Black | B65B 5/061 53/443 |
| 2010/0135760 | A1 * | 6/2010 | Hjornet | B25J 15/0616 414/744.8 |
| 2011/0005174 | A1 * | 1/2011 | Prahm | B65B 5/061 53/473 |

FOREIGN PATENT DOCUMENTS

| | | | |
|---|---|---|---|
| CN | 101977816 | A | 2/2011 |
| CN | 202072007 | U | 12/2011 |
| JP | H02-191106 | A | 7/1990 |
| JP | H02191106 | A | 7/1990 |
| JP | 723122 | B2 | 3/1995 |
| JP | 7257503 | A | 10/1995 |
| JP | 2004-268976 | A | 9/2004 |
| JP | 2011-512302 | A | 4/2011 |
| JP | 2011-241027 | A | 12/2011 |
| WO | 2009101621 | A2 | 8/2009 |
| WO | 2009103441 | A1 | 8/2009 |

OTHER PUBLICATIONS

Deutsches Patent—Und Markenamt (German Patent and Trademark Office), Recherchebericht (search on application), Nov. 27, 2012.

WIPO, International Search Report (on priority application), May 7, 2013.

State Intellectual Property Office of the People's Republic of China, Notification of the First Office Action and Search Report (for a related application), dated Jun. 2, 2015.

Japanese Patent Office, Office Action (in a related application), dated Aug. 31, 2016.

Colombia Industria y Comercio Superintendencia (Colombia Patent Office), Considerando (search in connection with a related application), dated Oct. 31, 2016.

* cited by examiner

METHOD AND APPARATUS FOR INSERTING PACKAGES INTO CARTONS

BACKGROUND OF THE INVENTION

Technical Field

The invention relates to methods and apparatuses for inserting items into containers, in particular for filling larger cartons with packs, such as foil packs or soft packs.

Prior Art

The handling of bag packs (for potato crisps) and the filling of cartons with bags of this type is the subject of WO 2009/103441. This prior art concerns the positioning of the foil bags with delicate content in different formations within a large-volume carton in order to make the best possible use of its interior, yet, on the other hand, to avoid mechanical damage to the bags. The known apparatus is equipped with (two) robots, which alternately hold ready erected and opened cartons in a packing station for the insertion of the bags. The cartons can be presented by the robot in different relative positions subject to the position of the cartons being altered during filling to ensure different packing patterns of the bags. These are inserted (exclusively) by a slide via an obliquely directed plane of conveyance into the carton. The bags here lie on a likewise tilted belt, from which they are pushed by the transversely movable slide and pushed into the carton.

BRIEF SUMMARY OF THE INVENTION

The invention concerns an improvement, in particular, of the above-described technology such that an optimal filling of containers or cartons with items, in particular (foil) packs, is possible with higher output.

For the achievement of this object, the method according to the invention is a method for inserting items into a container, in particular for inserting (foil or soft) packs into a carton to create an orderly formation of items or packs within the container or the carton, wherein the items or packs are fed one after another or in groups to a packing station and are inserted by at least one handling member into the container or carton, and the carton is movable into different filling positions by a handling device—carton robot—which grasps said carton, characterized in that a pack holder—head—of the handling member—pack robot—is displaceable, in coordination with the movements of the carton robot, along a plurality of, in particular along three coordinates, and is pivotable about a plurality of, in particular along three axes, such that, by rotation and/or tilting and/or linear movement of the carton, on the one hand, and by lifting and lowering movement of the packs and/or rotary movement or by insertion of these same, on the other hand, the carton is filled with different packing formations.

According to the invention, in the packing process complex movements are provided for the (open) carton, on the one hand, and for the packs to be inserted, on the other hand. The items to be brought together—carton and packs—are linearly displaceable by individual handling devices or mountings, preferably in three coordinates, and additionally—in case of superimposed movement—are rotatable or pivotable about preferably three axes. A gentle insertion of the packs into the carton and the creation of complex packing patterns are hence brought about by mutually coordinated linear and/or rotary movements of holding members for the carton, on the one hand, and for the packs to be inserted, on the other hand. The control of the members is realized via stored, selectable or downloadable programs.

A further particularity consists in the fact that the packs, in their delivery to the carton, can alternatively be grasped by a holder or holding head and can be handled by means of lifting and lowering movement. Alternatively or additionally, the packs are inserted into the carton by pushing. Preferably, a lifting head for the handling of the packs is configured such that alternatively packs can be grasped by means of suction air or can be moved by pushing (by the same lifting head).

A separate robot serves for the handling of the cartons, namely to take up the empty carton from a carton feed conveyor, transfer it to the packing station for the performance of the respectively necessary movements of the carton in the packing station, and to deposit the filled carton for the removal of the same. The handling of the cartons is achieved in a particular way. A (linearly movable) conveying member transports the filled carton by translatory motion onto a removal conveyor. The same member grasps a following empty carton and conveys this into the position for take-up by the robot.

Further features of the invention relate to members for opening or holding open the carton during the filling and to members for grasping the empty cartons, as well as the filled cartons, by means of robots.

BRIEF DESCRIPTION OF THE DRAWINGS

Details of the method and illustrative embodiments of the apparatus are explained in greater detail below with reference to the drawings, wherein.

DETAILED DESCRIPTION OF PREFERRED EMBODIMENTS

Figure 1:
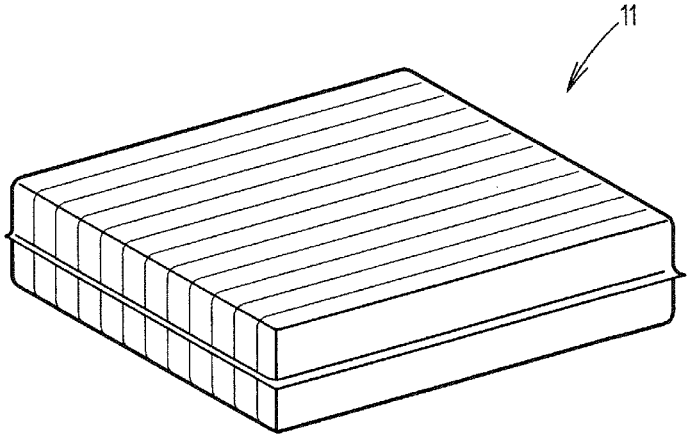
FIG. 1 shows a (foil) pack, by way of example, in perspective representation.
Figure 2:
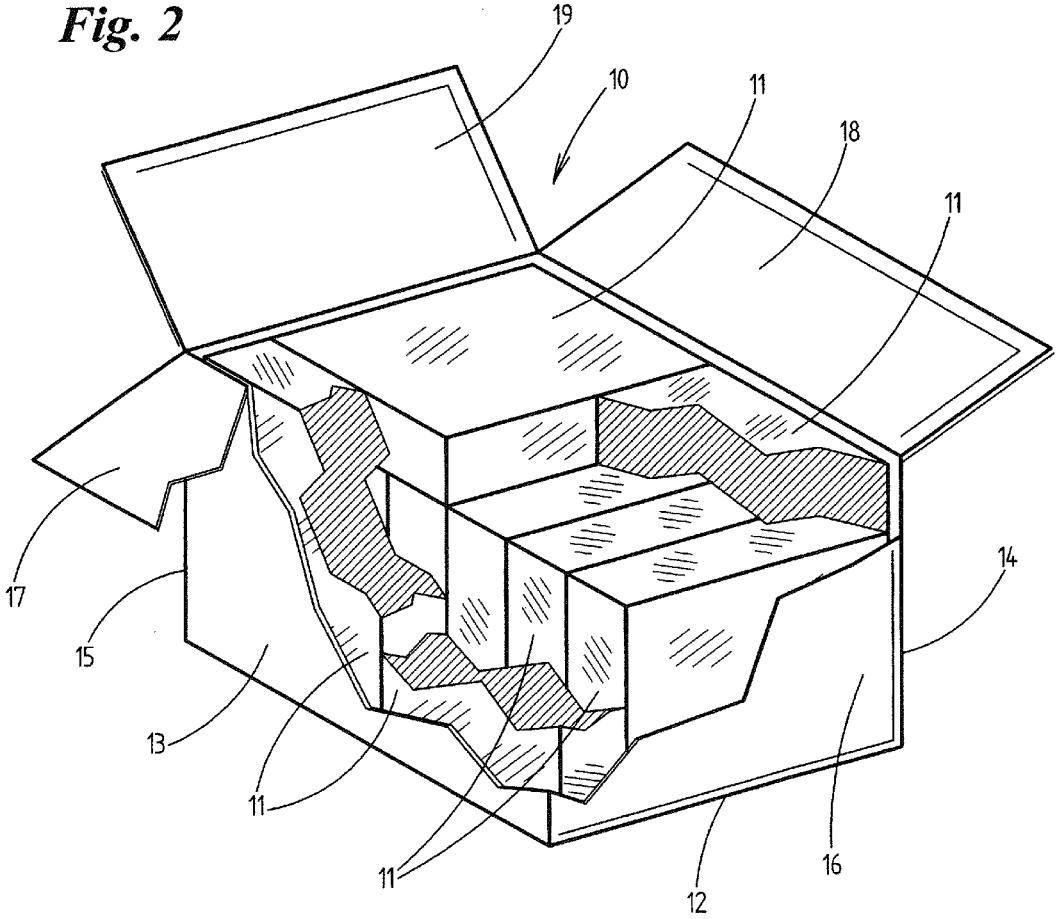
FIG. 2 shows an open, partially broken carton containing packs arranged in complex formation, in perspective representation.
Figure 3:
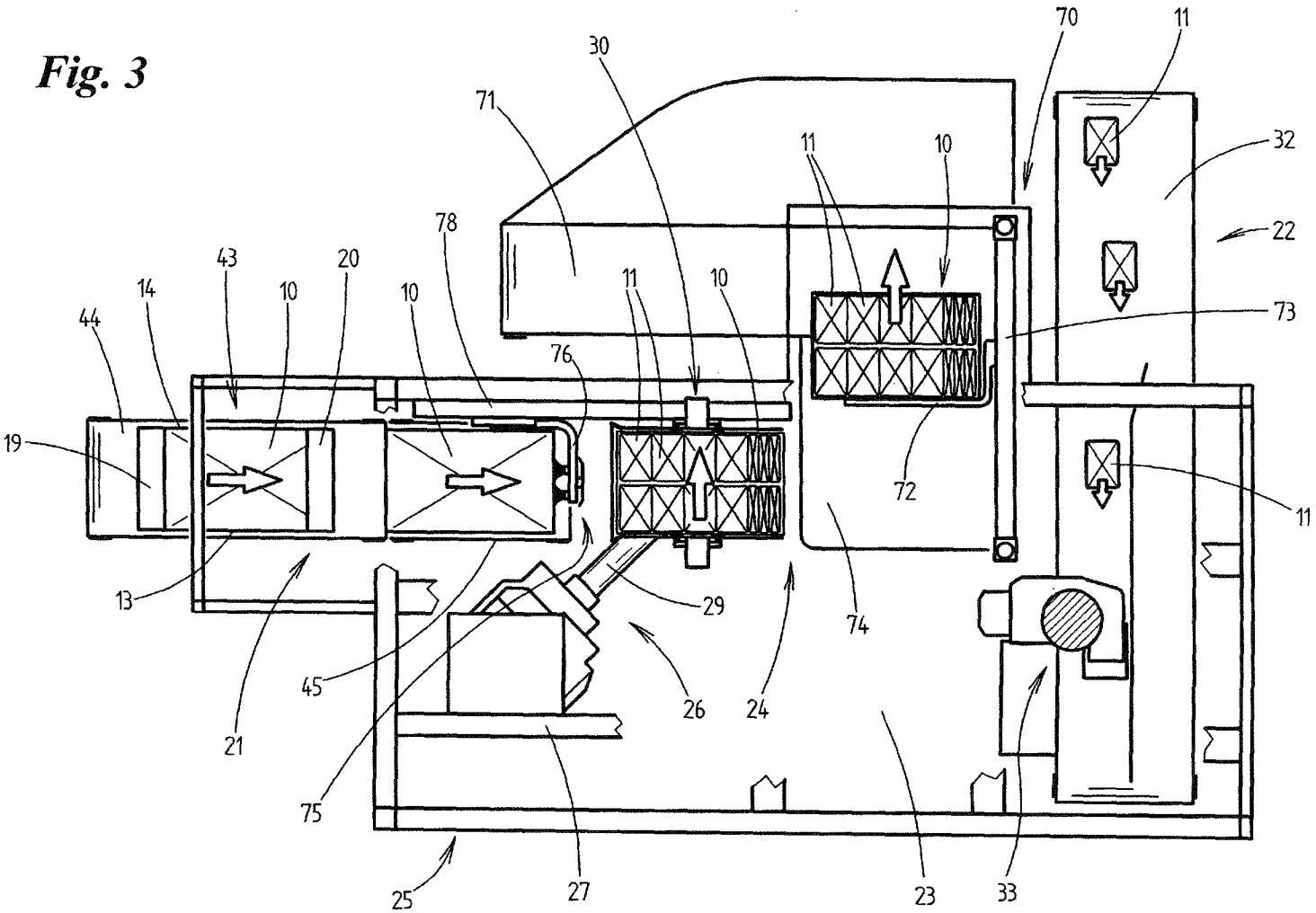
FIG. 3 shows a plant for the handling and filling of cartons, in top view.

FIG. 1 and FIG. 2 show a preferred example of use of the present technology, namely the filling of large-volume containers or cartons 10 with a plurality of individual items, namely packs 11. The latter can be configured as bags or can have a quadrilateral, in the present case flat shape. The example of FIG. 1 relates to a pack 11 having a foil wrapping, in particular for cellulose products, such as sanitary towels.

A (greater) number of packs 11 can be accommodated in different formations in the carton 10 such that this is optimally filled. The quadrilateral carton forms a bottom wall 12, lateral or vertical longitudinal walls 13, 14, (smaller) transverse walls 15, 16, as well as a top wall made up of longitudinal tabs 17, 18 and transverse tabs 19, 20.

In the example of FIG. 2, a number of packs 11 is arranged resting in upright position on the bottom wall 12, wherein the packs 11 of this group adjoin one another with large-area pack sides. Further packs 11 are likewise in upright position, but arranged crosswise in contact against the longitudinal wall 13. In the region of the upright packs 11 are positioned flat-lying packs 11, which lie with the large-area pack sides against the upright packs 11.

The basic structure of an apparatus for inserting packs 11 into cartons 10 consists of a carton supply 21, a pack supply 22, a packing station 23 and a carton station 24 for the handling and removal of the filled cartons 10. Members and units assigned to the individual stations are connected to a machine frame 25.

Core units of the apparatus are a handling device for the (empty and filled) cartons, and a further handling device for the packs 10. Both handling devices are configured such that, on the one hand, the cartons and, on the other hand, the packs can execute complex, mutually coordinated movements when the packs 11 are inserted into the carton 10. In the present case, both handling devices are configured as robots.

Figure 13:
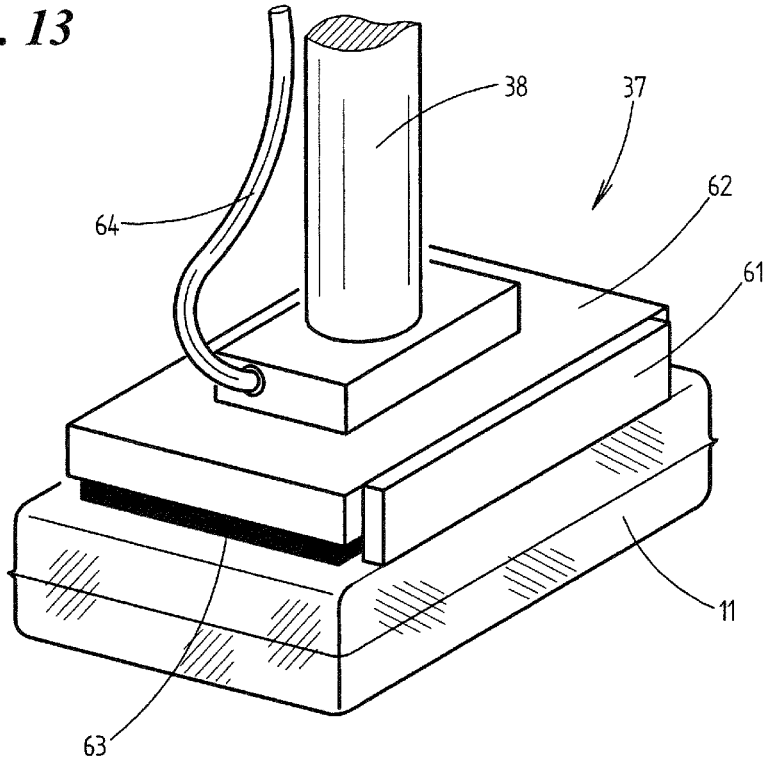
FIG. 13 shows a lifting head for the handling of packs on enlarged scale, in perspective view.
Figure 14:
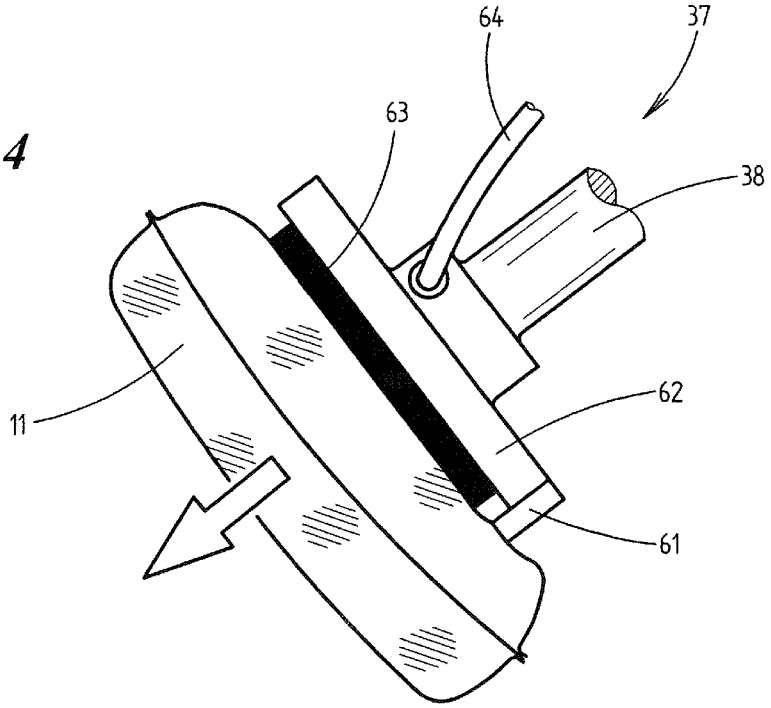
FIG. 14 shows the lifting head according to FIG. 13—with pack—in side view.

A first robot, namely the carton robot 26, serves for the handling of the cartons 10. In the present case, the carton robot 26 is rotatably mounted on an upper transverse beam 27 of the machine frame 25. A downwardly directed supporting arm 28 is pivotable and connected to a lower bracket 29. The latter is hence pivotable in the vertical direction and horizontal direction and, furthermore, is variable in length (telescopic). To the free end of the bracket 29 is attached a specially configured carton holder 30. This is pivotably connected to the end of the bracket 29 by a supporting piece 31. The packs 11 supplied on a pack conveyor 32 are taken up by an associated handling device and inserted into the ready-held carton 10. For this a robot is provided, namely a pack robot 33. This is disposed in the region of the packing station 23, to be precise on an upper part of the machine frame 25, namely on a longitudinal beam 34. The pack robot 33 is of two-armed configuration having a pivot arm 35 and a bracket arm 36 attached thereto. The arms 35, 36 are pivotable relative to each other and rotatable about, respectively, vertical and horizontal axes. To the free end of the bracket arm 36 is attached a pack carrier for grasping and transporting the packs 11. This is constituted by a specially configured head 37 (FIG. 13), which respectively grasps a pack 11 on a free top side (large-area pack side), preferably by means of suction air, and which takes up the packs 11 one after another from the pack conveyor 32 and feeds them to a ready-held carton 10 in the packing station 23. The head is connected to the bracket arm 36 by a pivotable and rotatable supporting rod 38. Via the supporting rod 38, the head 37 can be controlled and supplied with suction air.

The handling devices for cartons 10 and packs 11, i.e. the carton robot 26 and the pack robot 33, cooperate in a mutually coordinated manner, in particular in the region of the carton station 24 during filling of a carton 10. The carton robot 26 transports the (initially empty) carton 10 to the packing station 23, holds the carton 10 ready there and performs coordinated movements of the carton 10 during the packing process. The carton holder 30 is configured such that the carton 10, in a region remote from the opening side, in particular in the region of the bottom wall 12 and adjoining regions of the side walls, in particular longitudinal walls 13, 14, is grasped on the outside.

Figure 12:
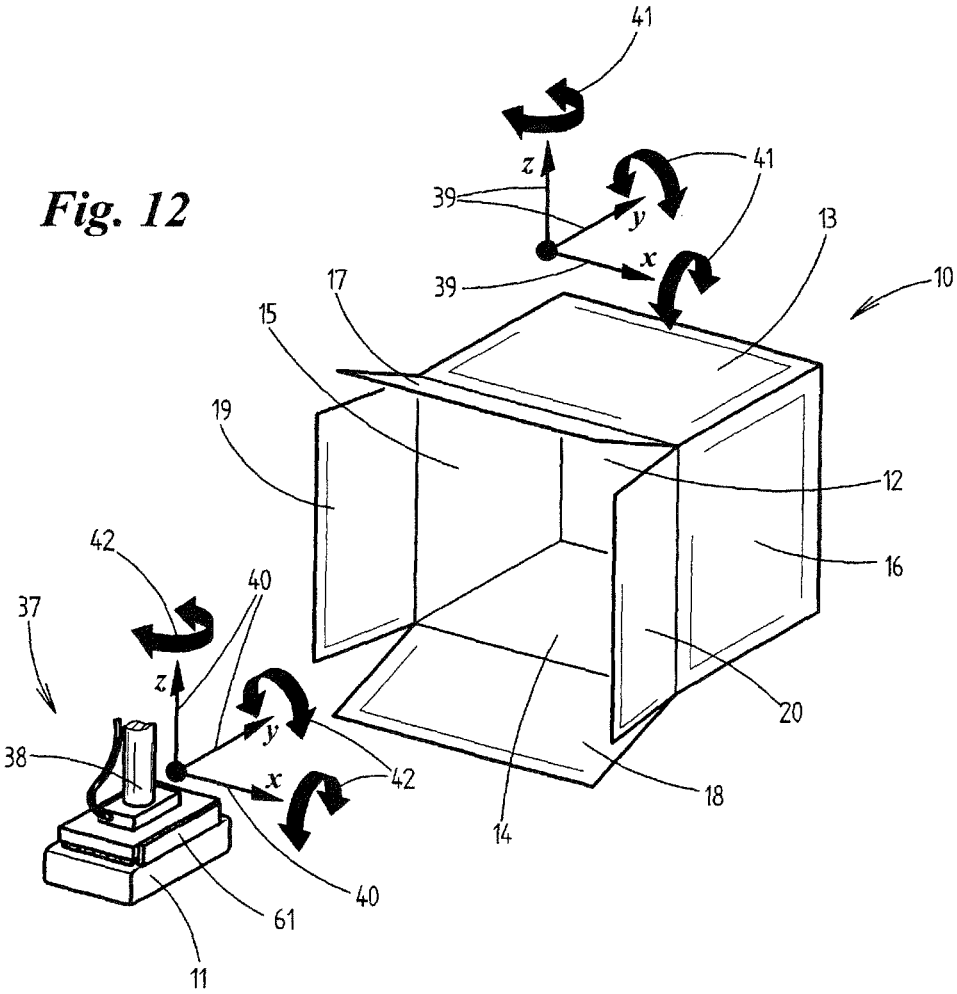
FIG. 12 shows a schematic representation of the degrees of freedom of movement of handling members of the carton, on the one hand, and of the packs, on the other hand, in perspective view.

During filling of a carton 10, this is held ready by the carton robot 26 in different, in particular alternating relative positions. Also the pack robot 33 and its head 37 execute different movements, coordinated to the position of the carton, when the packs 11 are inserted (individually) into the carton 10. As a result, the different packing formations (example in FIG. 2) can be created. The handling devices for the cartons 10 and packs 11 are preferably configured such that the carton holder 30 has a plurality of, in particular six motional degrees of freedom (FIG. 12). Expediently, the head 37 of the pack robot 33, by virtue of an appropriate arrangement, is likewise moved correspondingly. This involves linear movements, in accordance with three coordinates 39, 40, and a rotary or pivot movement along rotational axes characterized by double arrows 41, 42. The coordinates 39, 40 define movement along X-axes, Y-axes and Z-axes. The movements of the carton 10, on the one hand, and of the packs 11, on the other hand, are realized via a joint, central control system for both robots 26, 33.

The cartons 10 are fed in the region of the carton supply 21, by a carton conveyor 43 comprising successive sub-conveyors 44, 45 realized as a belt conveyor, to the carton station 24. The cartons 10 are largely ready-folded except for the (upwardly directed) folding tabs 17, 20. The longitudinal tabs 17, 18 point in the direction of conveyance.

In the carton station 24, an empty carton is respectively taken up by the carton robot 26 or its carton holder 30. By virtue of the particular configuration and working method of the carton holder 30, it is possible to position the (empty) carton 10, which is respectively to be taken up, in the working region of the (opened) carton holder 30. The carton holder 30 is of substantially U-shaped configuration (in cross section), to be precise having holding members on the bottom side and vertical lateral holding members. The arrangement is made such that an empty carton, in continuation of the supply movement subsequent to the carton conveyor 43, can be inserted directly into the carton holder 30. Following reception of a carton by the carton holder, holding members of the same are adjusted in order to grasp the carton effectively. For this, holding members 46, 47 are attached to the carton holder 30, which holding members preferably grasp the carton 10 in the holding position in the region of the base 12 and adjacent, upright carton walls—longitudinal walls 13, 14.

The holding members 46, 47 of the carton holder 30 have, on the one hand, mechanical supporting or guide members and, on the other hand, suction holders, which operate on the outer side of the carton. The thus configured carton holder is disposed on a bracket of the carton robot 26, to be precise on a supporting piece 31 on the end of the bracket 29 of the carton robot 26. The rod-shaped supporting piece 31 has a (quadrilateral) end piece 48, to which the members of the carton holder are fastened.

Figure 10:
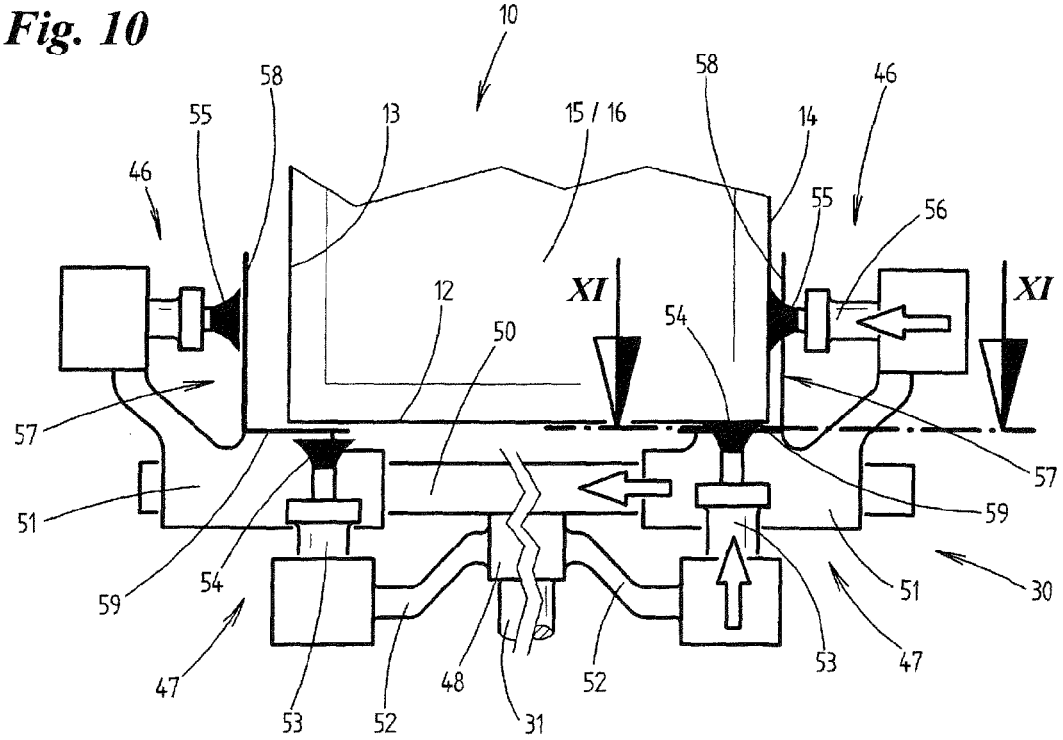
FIG. 10 shows a detail in the region of the supply of empty cartons in a sectional or viewing plane X-X of FIG. 4, on enlarged scale.

The lateral holding members 46 operate in a (lower) region of side walls—longitudinal walls 13, 14—, which region faces the bottom wall 12. The lateral holding members 46, respectively configured as a unit, are mounted displaceably (in the transverse direction) on a common support, to be precise on a crossbar 50 connected to the end piece 48. Each holding member 46 is assigned a tubular or sleeve-shaped crosspiece 51, which is displaceable on the crossbar 50, to be precise from an opening position (FIG. 10, left) at a distance from the carton 10 into a holding position for grasping of the carton (FIG. 10, left). The holding members 47 assigned to the bottom wall 12 are positioned at the edge (of the bottom wall), i.e. adjacent to the side walls 13, 14. The two holding members 47 are disposed on a support 52—in the form of a supporting arm.

The holding members 46, 47 have for the grasping of the carton 10 suction cups 54, 55. The bottom-side holding members 47 have a number of mutually adjacent suction cups 54, which can be moved up and down by means of a (pneumatic) cylinder 53, namely to the point of contact with the bottom wall 12 for grasping of the carton. Upon contact with the carton 10, a vacuum can be applied to the suction cups 54.

The lateral holding members 47 likewise have suction cups 55, which are mounted on transversely movable cylinders 56. These suction cups 55 can be propelled by the respective cylinder 56 out of a starting position (FIG. 10, left) into a holding position (FIG. 10, right) in contact against a side wall of the carton 10. Through the application of a vacuum, a holding force is transmitted to the carton.

Figure 11:
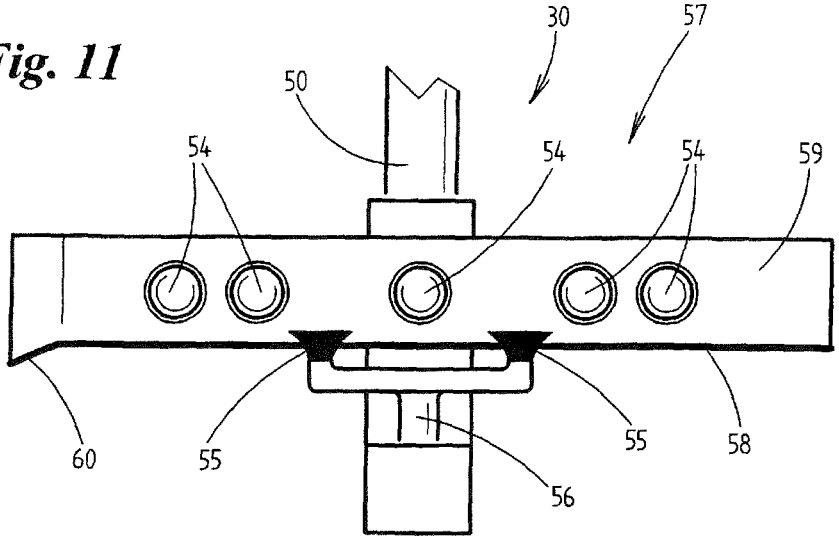
FIG. 11 shows a detail of the arrangement according to FIG. 10 in the sectional or viewing plane XI-XI.

Attached to the carton holder 30 are movable guide members, which secure the insertion and alignment of the carton 10 respectively into and in the region of the carton holder 30. These are constituted elongated guide profiles 57, of rail-like configuration, to both sides of the carton 10 (FIG. 10). The guide profiles 57, preferably consisting of an angular metal plate, respectively have a vertical side arm 58 and a horizontal bottom arm 59. The guide profiles 57 are connected to the transversely movable holding members 46, i.e. to the guide pieces 51. The guide profiles 57 are hence displaced with the suction cups 55 from a retracted starting position (FIG. 10, left) into the adjustment position (FIG. 10, right). On an inlet side, namely the entry side of an (empty) carton 10, the guide profiles 57 are provided with a funnel-shaped widening 60 (FIG. 11).

The holding force is predominantly transmitted by the suction cups 54, 55 to the carton 10. Expediently, the greater holding force is generated in the region of the bottom wall 12. As can be seen from FIG. 11, in the region of the bottom arm 59, a plurality of—five—suction cups 54 are arranged in the longitudinal direction of the carton 10. In the region of the side walls 13, 14, two suction cups 55 are in the present case arranged adjacent to each other (on a common support). The arms 58, 59 of the guide profile 57 have openings for the passage of the respective suction cups 54, 55. The horizontal bottom arms 59 are preferably arranged roughly in the plane of the carton conveyor 43 as a continuation of the same.

Figure 7:
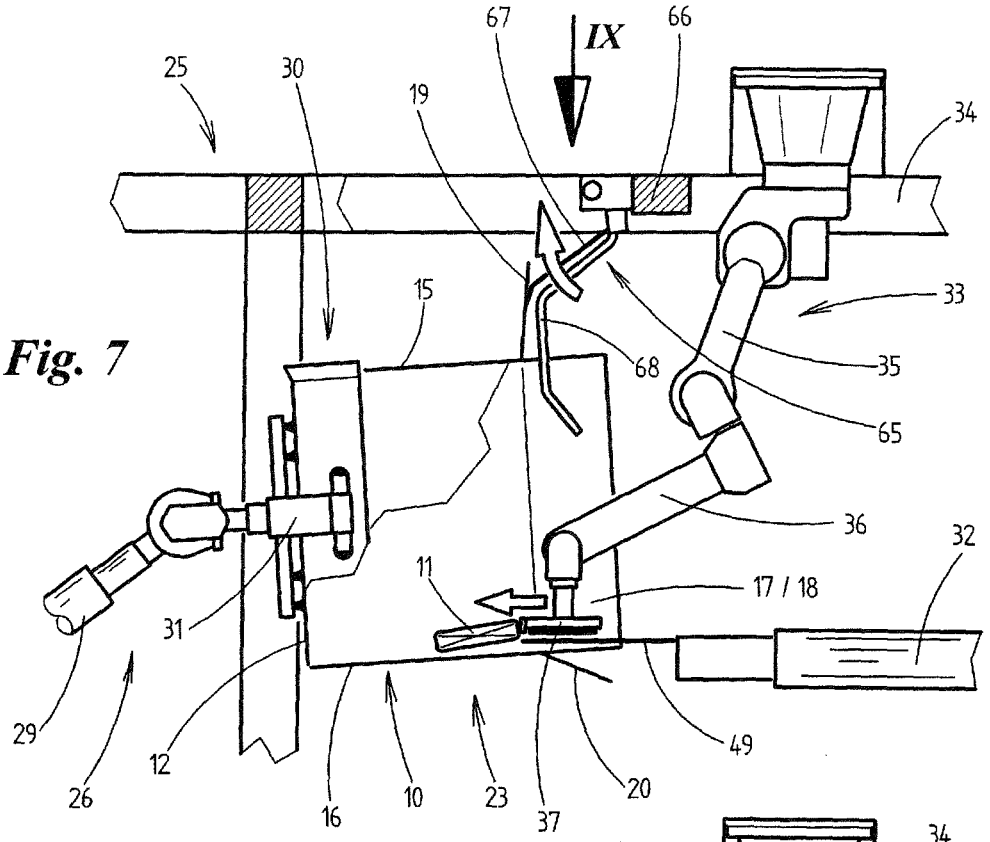
FIG. 7 shows the packing station as a detail in side view, on enlarged scale, during filling of a carton.
Figure 8:
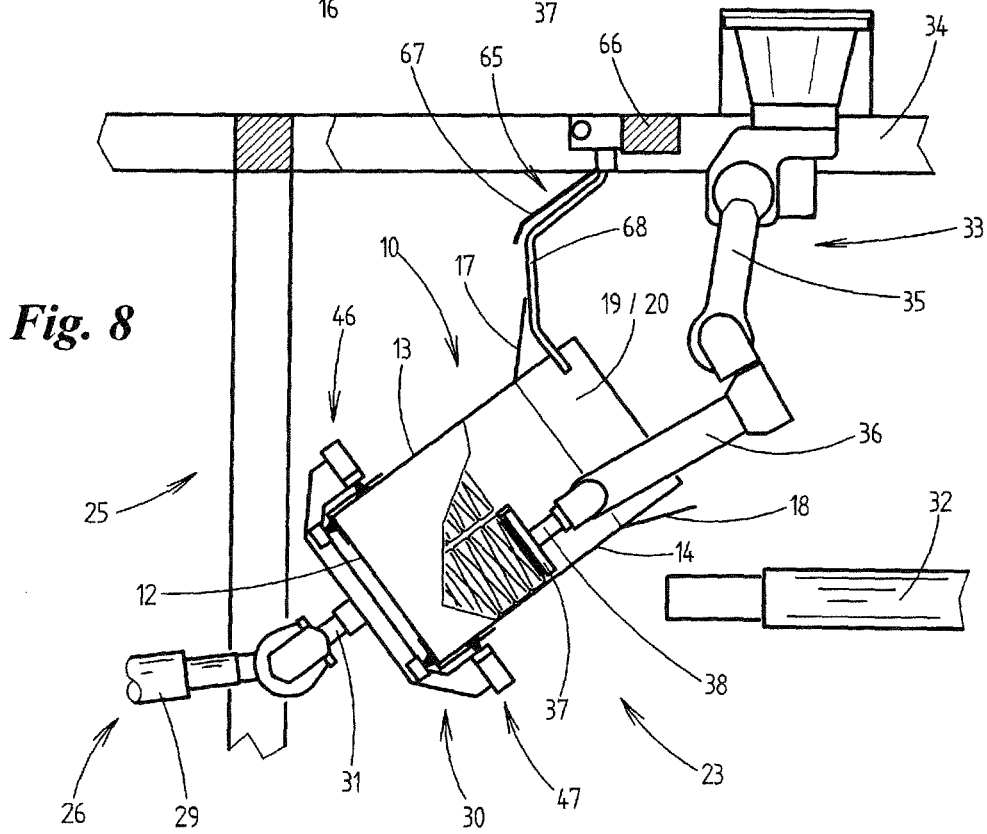
FIG. 8 shows the packing station according to FIG. 7, the relative position of the carton and of filling members having been altered.

The supplied (empty) carton 10 is transferred by the carton robot 26 out of the carton station 24 into the packing station 23 and is there held ready for filling. The open side of the carton is facing the pack robot 33 or its head 37 (FIGS. 7 and 8). Preferably, the carton is held in a (variable) oblique position. Depending on the dimensions of the carton 10 and of the packs 11, as well as the number of these same, packs 11 are deposited on the bottom wall 12 with the formation of one or more stacks. The pack robot 33 grasps respectively a pack 11 (or a plurality of packs side by side), holds these, in particular in the region of large surfaces, by means of suction air (FIG. 13), and intrudes with the head 37, and (partially) with the bracket arm 36, into the carton 10.

Alternatively, packs 11 are inserted into the carton 10 such that they directed with narrow sides toward the bottom wall 12 and bear with the larger pack surfaces against side walls of the carton 10. In this case, the packs 11 are inserted into the carton 10 by pushing. The head 37 is configured such that a function as a slide is given. On at least one side of the head is arranged a push bar 61, which, for the insertion, bears against a narrow side face of the pack 11 (FIG. 7). The insertion movement can be performed by the movement of the head 37 (by virtue of appropriate actuation of the pack robot 33). The push bar 61 is arranged on the side of a bearing plate 62 of the head 37 and is dimensioned or arranged in height such that a free edge of the push bar 61, when a pack 11 is grasped, bears against this same. The head 37 is provided on the free side of the bearing plate 62 with one or more suction members for grasping the pack 11, in the present case with a plate-like suction body 63 made of elastic material (foam) and preferably a plurality of suction bores (not shown). The vacuum for the grasping of a pack 11 is supplied to the suction body 63 via a (suction) line 64 and via the bearing plate 62.

By virtue of the arrangement, the push bar serves as a supporting member in the reception of a pack 11. Since this is grasped only in the region of the outer wrapping (upper foil wall), un unfavorable deformation of the (unstable) pack 11 is obtained. The push bar 61, which bears against the pack 11 by virtue of the relative position, effects a compensation of the tilt of the pack 11.

The packing station 23 can be equipped with an implement which is used in the insertion of packs 10, namely with a sliding plate 49. This is arranged alongside the pack conveyor 32 in the region of the packing station 23, to be precise as a continuation of the bearing surface for the slidingly moved pack 11. The sliding plate 49 extends substantially in the plane of the pack conveyor 32 as a continuation, preferably extending into the region of the ready-held carton 10 (FIG. 7). The head 37 is preferably arranged at a short distance above the sliding plate 49 for the purpose of a sliding movement. The sliding plate 49 is retractable—in the event of the load in accordance with FIG. 8.

The packing station 23 is assigned a tab holder 65 for fixing the closing tabs 17, 20 of the carton in the open position during the filling process. The tab holder 65 is attached to the machine frame 25, to be precise in a region above the working plane of the packing station 23 and mounted on a bearing profile 66 of the machine frame 25—in the plane of the (upper) longitudinal beam 34.

Figure 9:
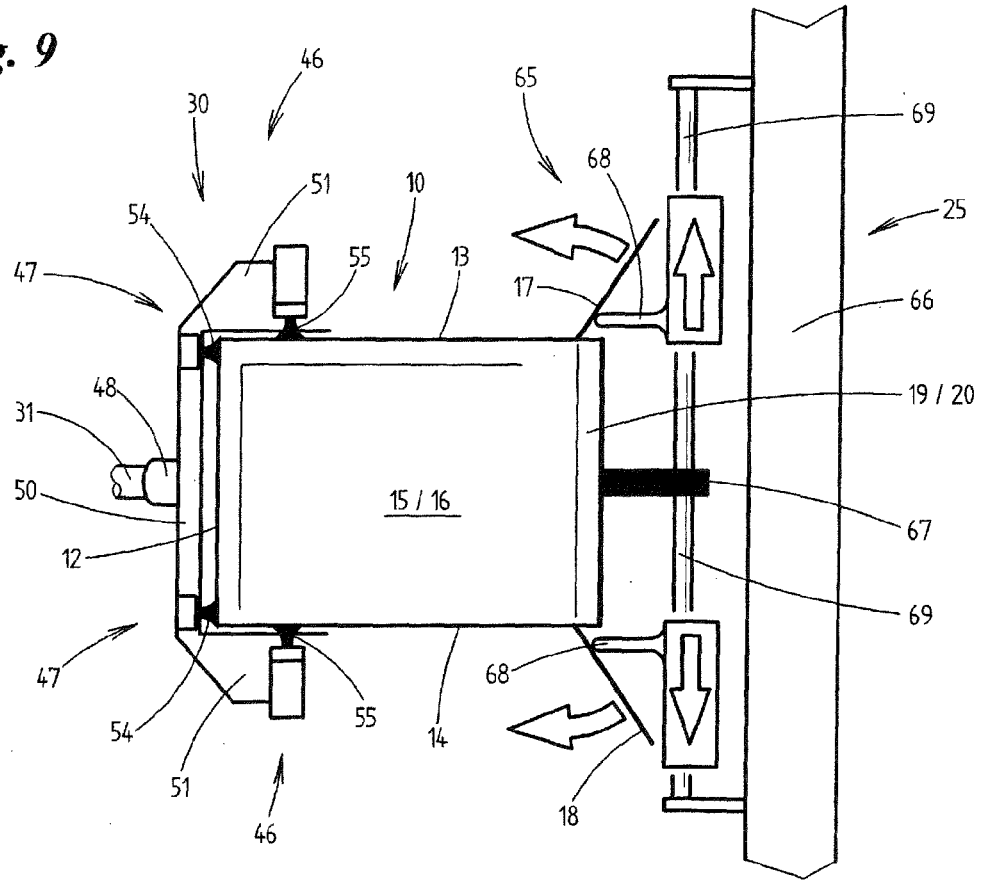
FIG. 9 shows the packing station in a top view in accordance with the arrow IX in FIG. 7.

The tab holder 65 consists of a plurality of preferably movable members, which fix an upwardly directed transverse tab 19 and the two—given the present relative position—upright longitudinal tabs 17, 18 in a funnel-shaped opening position. A first, roughly central holding web 67 comes to bear against the inner side of the transverse tab 19 (FIG. 7). The laterally positioned longitudinal tabs 17, 18 are assigned support bars 68, which are displaceable on a holding rod 69, namely in the direction toward or away from each other. When the carton 10 arrives in the packing station 23, the two support bars 68 are moved apart in opposite directions out of a roughly central starting position, whereby the folding tabs 19, 20 make their way into an opening position in accordance with FIG. 9. The transverse tab 19 is held by the holding web 67 likewise in the opening position.

The support bars 68 are displaceable with sleeve-like guides on the holding rod 69, with adjustment to the width of the carton 10.

Figure 6:
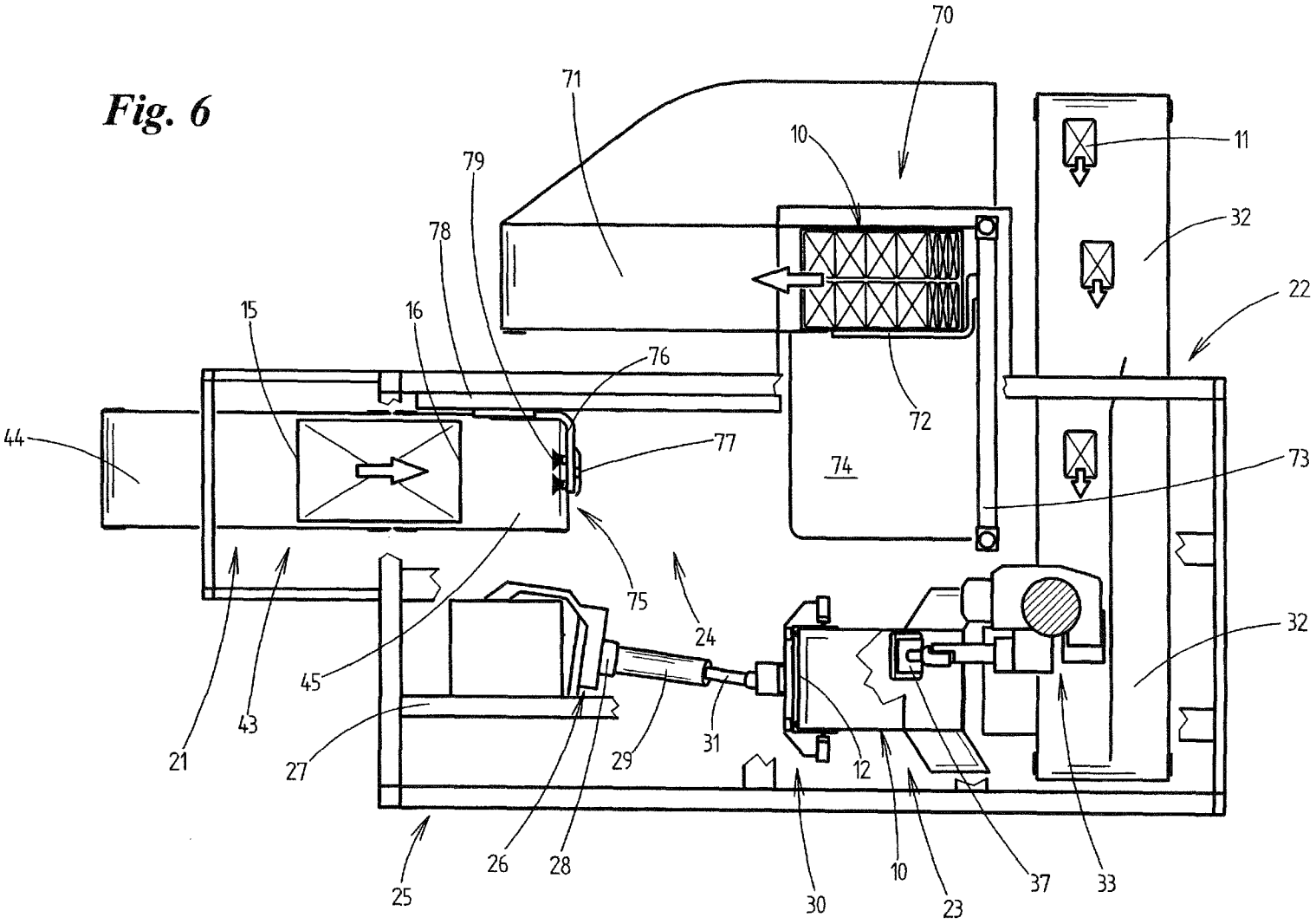
FIG. 6 shows a top view of the apparatus analogous to FIG. 3, FIG. 4, during filling of a carton in a packing station.

The carton robot 26 assumes the task of removing the filled carton 10 from the region of the packing station 23 via a transport section. The filled carton 10 is (re)deposited by the carton robot 26 in the carton station 24 or is held by the carton holder 30 in a push-off position subsequent to the carton conveyor 43, namely at the end of the sub-conveyor 45. The carton 10 is then—with the closing tabs 17, 20 still open—pushed off from the region of the carton holder 30 and delivered to a removal conveyor 70. This transports the carton 10 in the transverse direction to a discharge belt 71, once again transversely to the transport direction in the region of the removal conveyor 70. The removal conveyor 70 adjoining the carton station 24 is configured as a linear conveyor, having an (angular) slide 72, which can be moved back and forth by a linear drive 73, wherein, in a starting position (FIG. 4), the carton 10 makes its way into a transport position for the slide 72. FIG. 6 shows the opposite end position of the slide 72, in which the carton 10 is deposited on the discharge belt 71. In the region of the removal conveyor 70, the carton 10 stands or rests on a plate-like underpass 74. On this, the carton 10 is slidingly transported by the slide 72.

A particularity is the transport of cartons 10, namely of the filled carton, on the one hand, and of the following empty carton, on the other hand, in the region of the carton station 24. The filled carton is moved out of the region of the carton holder 30 by a push member. At the same time, a following (empty) carton 10 is inserted into the carton holder 30, in the present case by the same member. An (angularly configured) pusher 75 is located with a driver or arm 76 in the region between two successive cartons. On the arm 76 acting as a slide is arranged, on the side lying to the (filled) carton 10 to be pushed off, a support profile 77, which comes to bear against the rear side of the carton 10—rear transverse wall 15. By a linear drive 78 beside the motional path of the cartons, the carton 10 (with content) held ready by carton robot 26 is expelled from the region of the carton holder 30 by the pusher 75 and pushed out onto the underpass 74 of the removal conveyor 70.

Figure 4:
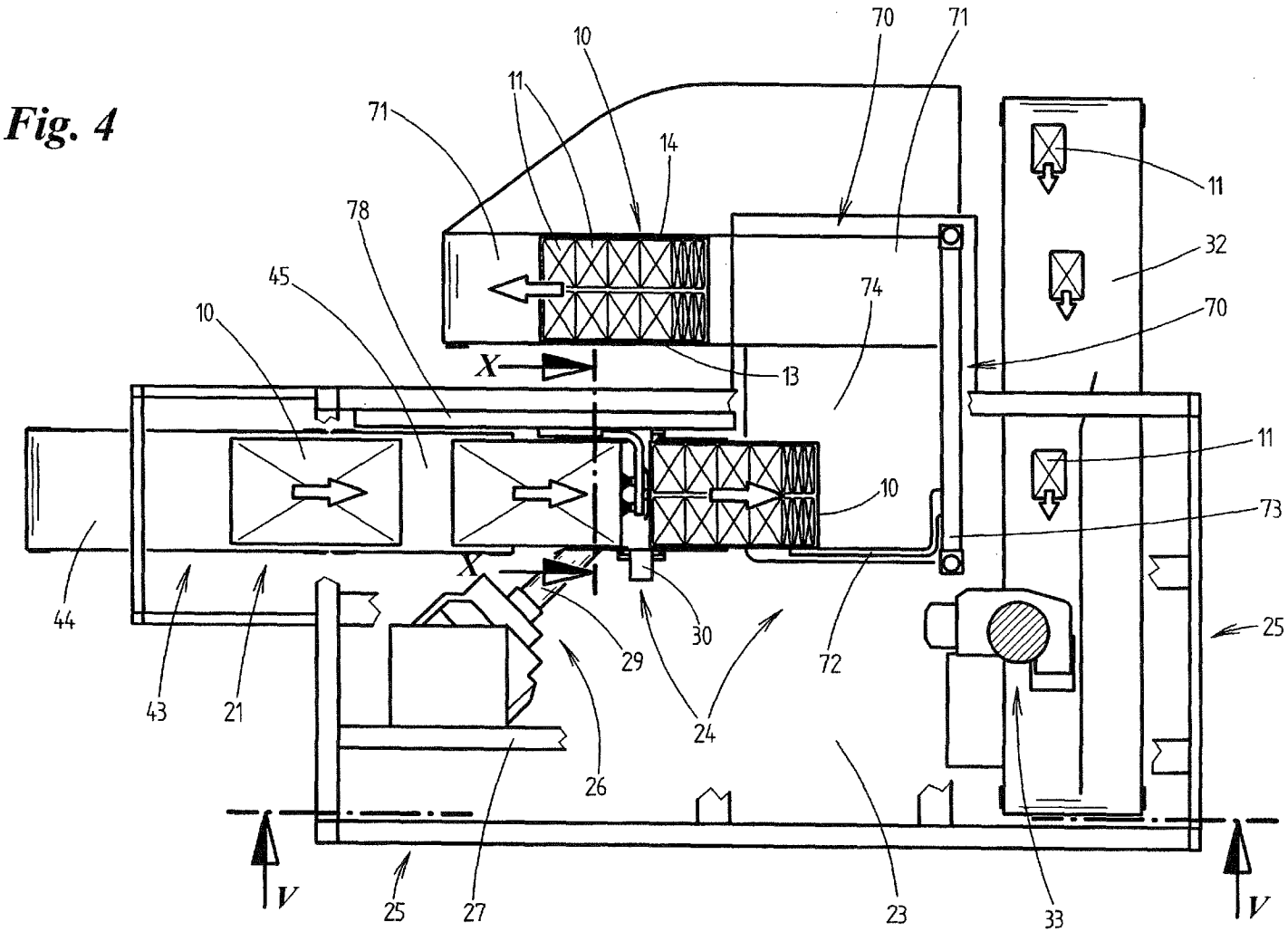
FIG. 4 shows the plant according to FIG. 3, the position of members having been altered, likewise in top view.
Figure 5:
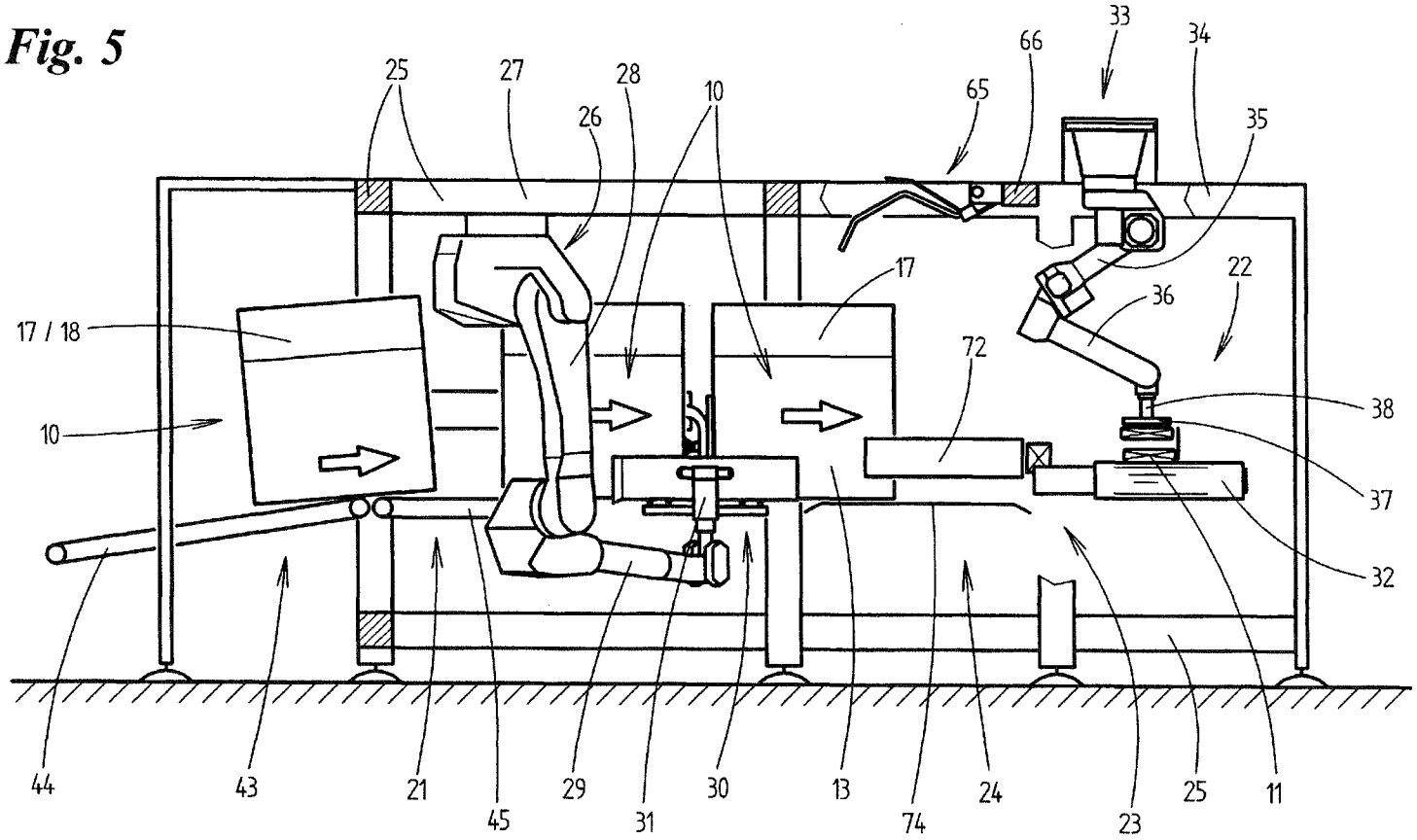
FIG. 5 shows a side view of the apparatus in a sectional or viewing plane V-V of FIG. 4.

The pusher 75 at the same time effects the delivery of the following empty carton 10 to the ready-held carton holder 30. The pusher 75 or the transverse arm 76 has drivers for the following carton 10, to be precise suction members 79, which point rearwards with respect to the direction of conveyance, come to bear against a front-situated wall of the carton 10—transverse wall 16—and take hold of this by means of suction air. During the push-off movement of the filled carton 10 by the pusher 75, the following empty carton is thus pulled along behind and delivered to the carton holder 30 (FIG. 4).

The working method of the robots 26, 33, which is mutually coordinated in terms of the relative movements, can be applied in the creation of complex packing formations, but also in the handling of packs and/or cartons of different dimensions and/or shapes, to which the positions of the carton, on the one hand, and the movements of the packs, on the other hand, can be optimally adjusted during the packing process.

REFERENCE SYMBOL LIST

10 carton
11 pack
12 bottom wall
13 longitudinal wall
14 longitudinal wall
15 transverse wall
16 transverse wall
17 longitudinal tab
18 longitudinal tab
19 transverse tab
20 transverse tab
21 carton supply
22 pack supply
23 packing station
24 carton station
25 machine frame
26 carton robot
27 transverse beam
28 supporting arm
29 bracket
30 carton holder
31 supporting piece
32 pack conveyor
33 pack robot
34 longitudinal beam
35 pivot arm
36 bracket arm
37 head
38 supporting rod
39 coordinate
40 coordinate
41 double arrow
42 double arrow
43 carton conveyor
44 sub-conveyor
45 sub-conveyor
46 holding member
47 holding member
48 end piece
49 sliding plate
50 crossbar
51 guide piece
52 support
53 cylinder
54 suction cup
55 suction cup
56 cylinder
57 guide profile
58 side arm
59 bottom arm
60 widening
61 push bar
62 bearing plate
63 suction body
64 line
65 tab holder
66 bearing profile
67 holding bar
68 support bar
69 holding rod
70 removal conveyor
71 discharge belt
72 slide
73 linear drive
74 underpass
75 pusher
76 arm
77 support profile
78 linear drive
79 suction member

What is claimed is:

1. A method for inserting packs into a carton to create an orderly formation of packs within the carton, comprising:

feeding the packs one after another or in groups to a packing station, the packs being inserted by at least one pack robot into the carton, wherein an empty carton is movable into different filling positions in the packing station by a carton robot which grasps the empty carton, wherein a head of the pack robot is displaceable, in coordination with the movements of the carton robot (26), along three coordinates, and is pivotable about three axes, such that, by rotation and/or tilting and/or linear movement of the empty carton, on the one hand, and by lifting and lowering movement of the packs and/or rotary movement or by insertion of these same, on the other hand, the empty carton is filled with different packing formations, resulting in a filled carton;

inserting by transport the empty carton into an open carton holder of the carton robot and fixing the empty carton in place through closure of the carton holder by mechanical and/or pneumatic holding members; and when the empty carton is introduced into the region of the carton holder, conveying the filled carton out of the region of the carton holder at the same time, the filled carton being conveyed by pushing the filled carton out of the region of the carton holder and the empty carton being conveyed by pulling the empty carton into the region of the carton holder by means of a pusher, wherein, the filled carton is pushed out of the region of the carton holder at the same time as the empty carton is pulled into the region of the carton holder.

2. The method as claimed in claim 1, wherein the packs are grasped by the thereto assigned pack robot by means of suction air, and are transported into the empty carton by lifting and lowering or alternatively are inserted into the empty carton by pushing, wherein the head of the pack robot serves as a driver or as a slide for the packs.

3. The method as claimed in claim 1, wherein:

a) the empty carton is erected by folding and is transported with an open top side along a carton supply to a carton station;

b) the empty carton is grasped in the region of the carton station by the carton robot, is fed to the packing station, and is held ready in the packing station for the reception of the packs;

c) the packs are supplied by a pack conveyor and are grasped by the pack robot in the region of the packing station and inserted into the empty carton to the point of filling of the same, resulting in the filled carton; and d) the filled carton is then delivered by the carton robot to a removal conveyor.

4. The method as claimed in claim 1, wherein the cartons are grasped and held by the carton holder of the carton robot in the region of longitudinal walls extending in the direction of conveyance in a region facing a bottom wall and on the bottom wall of the cartons by suction cups which act on the longitudinal walls and the bottom wall.

5. An apparatus for inserting packs into a carton to create an orderly formation within the carton, comprising:

a packing station;

a carton robot for grasping an empty carton and holding the empty carton in the packing station for the reception of the packs, the relative position being altered during the packing process;

a pack robot for inserting the packs individually following one upon the other into the empty carton to create the formation, the pack robot comprising a pack holder having a head which transports the packs, in coordination with movements of the carton robot, by virtue of linear mobility, along a plurality of coordinates and/or, by virtue of rotatability, about a plurality of axes, involving take-up in the packing station and delivery to a carton held ready by the carton robot;

a carton station, wherein the empty carton is grasped by the carton robot in the carton station and is fed to the packing station for filling, and a filled carton is conveyed by the carton robot back into the carton station, wherein the filled carton is pushed by a pusher out of a carton holder of the carton station to a removal conveyor;

a carton conveyor for transporting the empty carton to the carton station; and a delivery member for introducing the empty carton into the region of the carton holder adjoining the carton conveyor, by the pusher, wherein, when the filled carton is pushed out of the region of the carton holder, at the same time the empty carton is introduced into the region of the carton holder.

6. The apparatus as claimed in claim 5, wherein the carton robot has the carton holder for grasping a carton with the aid of movable holding members, which preferably grasp the carton in the region of a bottom wall and in the region of side longitudinal walls adjacent to the bottom wall, wherein the holding members have suction cups for grasping the carton by means of vacuum in the region of the side longitudinal walls and in the region of the bottom wall.

7. The apparatus as claimed in claim 6, wherein the carton holder has guides in the nature of lateral, angular guide profiles, for supporting the carton upon insertion into the carton holder, in continuation of the direction of conveyance for empty cartons.

8. The apparatus as claimed in claim 5, wherein the pusher has an arm with a support profile (77) for pushing off filled carton, and wherein the pusher has on a rear side suction members for grasping a front side of the empty carton.

9. The apparatus as claimed in claim 5, wherein the head of the pack robot is movable as a slide for the insertion of the packs into the empty carton, wherein the head, in the region of a bearing plate, has a laterally fitted push bar for grasping one of the packs in the insertion movement.

10. The apparatus as claimed in claim 9, wherein, when the packs are inserted into the empty carton by the head of the pack robot, a sliding plate bridging member is extendible for bridging the distance between the pack conveyor and the empty carton.

11. The apparatus as claimed in claim 5, further comprising tab holders, which operate at least in the region of the packing station, for fixing folding tabs of the empty carton in the opening position, wherein the tab holder has at least one holding bar for grasping an, in the filling position of the empty carton, upper folding tab, and transversely movable support bars for, in the filling position of the empty carton, lateral folding tabs.

12. The apparatus as claimed in claim 5, wherein the filled carton, subsequent to the carton station, in continuation of the direction of feed of the empty cartons, is pushed onto a plate-like underpass of a removal conveyor and is fed by a transversely movable slide on the underpass to a discharge belt directed transversely to the removal conveyor.

* * * * *